US006141495A

United States Patent [19]

Roth

[11] Patent Number: 6,141,495

[45] Date of Patent: Oct. 31, 2000

[54] PORTABLE FLUE HEATER TO REDUCE OR ELIMINATE DOWNDRAFTS

[76] Inventor: Asher Roth, 2121 Raven Tower Ct., Apt. 104, Herndon, Va. 20170

[21] Appl. No.: 09/480,630

[22] Filed: Jan. 10, 2000

Related U.S. Application Data

[63] Continuation-in-part of application No. 09/148,148, Sep. 4, 1998.

[51] Int. Cl.[7] ..... F24H 3/00

[52] U.S. Cl. ..... 392/363; 392/365; 392/350; 126/293; 126/536; 126/500; 454/43

[58] Field of Search ..... 392/379–381, 392/383–385, 363, 365, 350, 307; 219/201, 526; 126/500, 293, 292, 536; 454/43; 55/DIG. 30; 422/174

[56] References Cited

U.S. PATENT DOCUMENTS

| | | | |
|---|---|---|---|
| 427,574 | 5/1890 | Howard | 392/350 |
| 901,871 | 10/1908 | Blanchard | 392/384 |
| 950,599 | 3/1910 | McGerry | 392/350 |
| 1,389,252 | 8/1921 | Lucas | 454/43 |
| 1,401,500 | 12/1921 | Scott | 392/350 |
| 1,490,088 | 4/1924 | Bridges | 392/383 |
| 1,750,094 | 3/1930 | Emmrich | 392/381 |
| 1,759,830 | 5/1930 | Blanchard | 454/43 |
| 2,121,754 | 6/1938 | Cornell, Jr. | 219/203 |
| 2,859,535 | 11/1958 | Carlson | 392/381 |
| 3,025,382 | 3/1962 | Eisele | 392/350 |
| 3,102,185 | 8/1963 | Boyd et al. | 392/350 |
| 3,622,752 | 11/1971 | Brasch | 392/350 |
| 3,835,290 | 9/1974 | Peters | 219/205 |
| 4,213,947 | 7/1980 | Fremont et al. | 422/774 |
| 4,920,866 | 5/1990 | Hoban . | |
| 5,058,193 | 10/1991 | Appierto | 392/384 |
| 5,873,178 | 2/1999 | Johnson | 34/90 |

FOREIGN PATENT DOCUMENTS

| | | | |
|---|---|---|---|
| 2018142 | 12/1991 | Canada . | |
| 21312 | 5/1961 | German Dem. Rep. | 392/379 |
| 1097055 | 1/1961 | Germany | 392/381 |
| 470134 | 12/1952 | Italy | 392/363 |
| 6-146661 | 5/1994 | Japan . | |
| 2039912 | 7/1995 | Russian Federation . | |
| 421405 | 3/1967 | Switzerland | 392/381 |
| 206118 | 7/1924 | United Kingdom | 392/350 |
| 2172981 | 10/1986 | United Kingdom . | |
| 2281611 | 3/1995 | United Kingdom | 454/43 |

*Primary Examiner*—John A. Jeffery
*Attorney, Agent, or Firm*—Hoffman Wasson & Gitler

[57] ABSTRACT

A flue heater is detachably secured to the flue of a chimney. The flue heater uses an electrical power source to create heat and direct the heated air into the lower portion of a flue. The device can be attached to the flue before igniting a fire and removed immediately prior to lighting a fire. The device can be used with any pre-existing chimney without the need for any large expense in retrofitting a permanent flue heater.

4 Claims, 7 Drawing Sheets

SIDE VIEW

OVERHEAD VIEW

OVERHEAD VIEW

OVERHEAD VIEW

PORTABLE FLUE HEATER TO REDUCE OR ELIMINATE DOWNDRAFTS

This application is a continuation-in-part of Ser. No. 09/148,148, filed Sep. 4, 1998.

FIELD OF THE INVENTION

The invention is a flue heater used to heat the air within the flue of a chimney prior to igniting a fire in the fireplace.

BACKGROUND OF THE INVENTION

Chimneys are provided in many homes and townhouses. They are valued by the homeowner for their aesthetic appeal and the fact that they can be used during the colder months to generate heat to, at least in part, heat the home. The fireplaces are generally used in the colder months when the outside air is considerably colder than the interior temperature. When the flue is open, cold air from outside the home can travel down the chimney and into the room that houses the fireplace. This is due to by the fact that the cold air outside is denser than the warm air inside. When the homeowner initially ignites a fire, this downdrafting of cold air can carry the smoke and fumes from the fire into the home. This is a very undesirable result.

The prior art discloses many flue heating devices which are built into the chimney. One such device is disclosed in U.S. Pat. No. 4,920,866 (Hoban). This device consists of a heater element 2 and a fan 3. The fan activates to blow the air heated by the heating element 2 into the chimney. This heated air flows up the chimney and creates an updraft through the chimney. When the fire is started, this updraft will carry the smoke and fumes from the fire up the chimney and out of the home. The device of Hoban is equipped with a downdraft sensor 9 activating the heater and fan when a downdraft is detected.

The prior art shows these types of devices that are permanently built into the chimney. This has the inherent disadvantage that the device needs to be installed when the chimney is built. Retrofitting a chimney in the millions of fireplace-equipped homes without such a device is costly and time-consuming. The homeowner, therefore, must choose this option when the home is being built. Such an expense may seem frivolous at a time of new construction when finances for the prospective homeowner are tight.

It is an object of the invention to provide a portable flue heater which can be used on any existing chimney.

It is another object of the invention to provide a flue heater that is inexpensive and easy to operate.

It is still another object of the invention to provide a flue heater that creates an updraft in a chimney to prevent smoke from being carried into the home.

These and other objects of the invention will become clear to one already skilled in the art after consideration of the disclosure of the invention that follows.

SUMMARY OF THE INVENTION

The invention is a small device having a heating element and a blower that directs the heated air upwards into a flue. The device is electrically powered and can be used in any pre-existing chimney by mounting it within the chimney and connecting it to a standard electrical outlet. The electrical cord connecting the device to the electrical outlet is provided with a controlling unit to operate the device remotely. The electrical power provided to the device supplies not only the heat through electric heating coils, but also drives an electric fan for forcing the heated air upwards through the flue. The device is inserted into the flue and operated for a sufficient time to heat the air within the flue creating an updraft. After an updraft of heated air is established, the device is removed immediately prior to igniting the fire in the fireplace.

BRIEF DESCRIPTION OF THE DRAWINGS

The invention will be fully described with reference to the drawings.

DETAILED DESCRIPTION OF THE DRAWINGS

Figure 1:
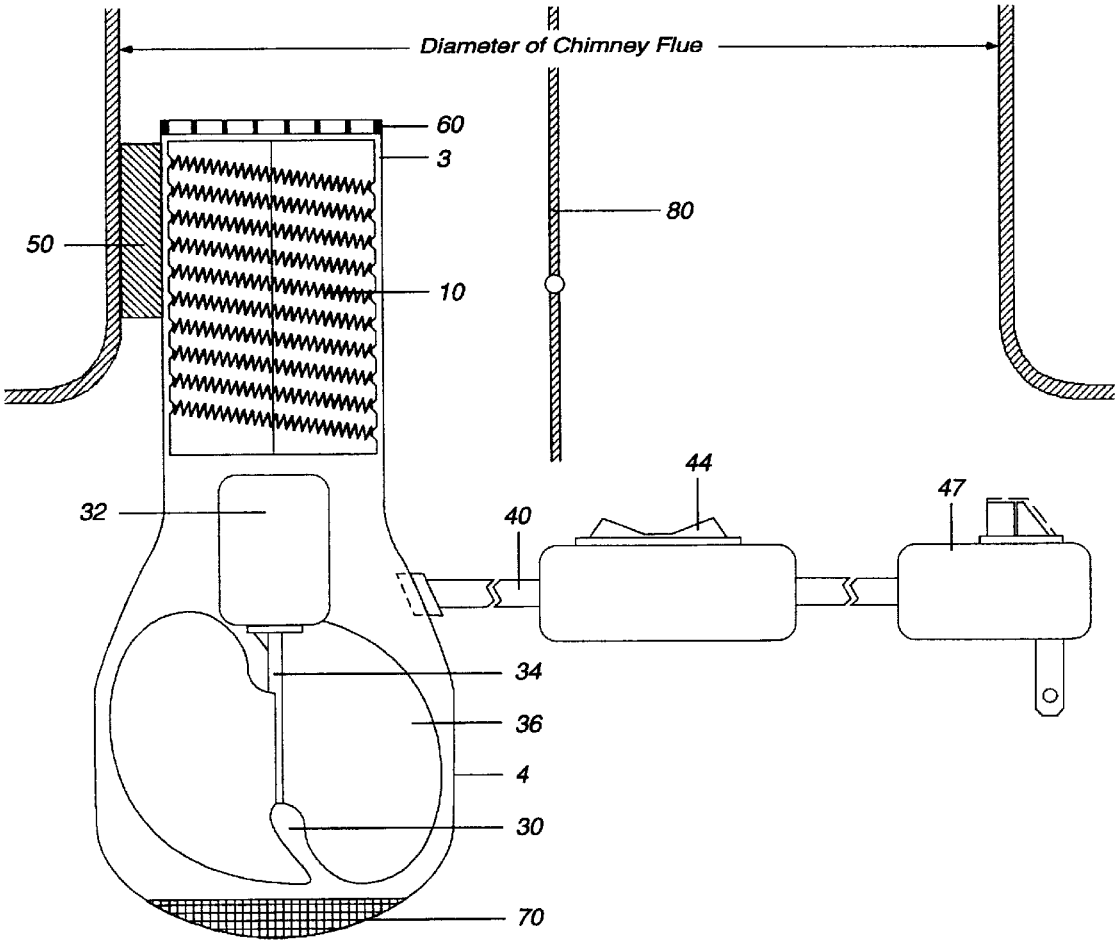
FIG. 1 is a side cross-sectional view of the device mounted within a flue.

As can be seen in FIG. 1, the outer casing of the device has an upper cylindrical portion and a lower bulbous portion. The upper cylindrical portion contains the electrical heating element 10. Below the electrical heating element 10 is a blower 30. The blower is made up of a motor 32 which drives a drive shaft 34. Connected to the drive shaft 34 are fan blades of fan 36.

Power is supplied to the device by an electrical cord 40. A rocker switch 44 is supplied in-line of the electrical cord for selectively supplying power to the device. The user would operate the device with the rocker switch. The plug 47 of the electrical cord 40 is provided with a ground fault reset. The plug is a conventional plug that would fit into any household AC wall outlet.

At least one magnet 50 is supplied on the upper cylindrical portion 3 to secure the device to the standard chimney flue. In place of the magnet, the device could be provided with a spring action clip that permits it to be easily attached to the interior metal portion of a flue or flue cover (damper). The top of the cylindrical portion is closed by a metal protective exhaust grill 60. This grill serves to keep foreign objects away from the electrical heating coil. The opposite end of the device is closed by a fine metal mesh protective grill 70. In use, the mesh protective grill 70 allows air to enter the device while preventing ashes and other small debris from entering the device during its operation. The fan draws air into the device through the screened opening and pushes the air through the device past the electrical heating coil 10. The heated air then exits from the device through the exhaust grill at the opposite end of the device. The forced hot air produced by the device creates an updraft of heated air within the flue. This updraft will convey smoke and fumes from a fire that is started in the fireplace. The device is removed immediately prior to the fire being started.

Figure 2:
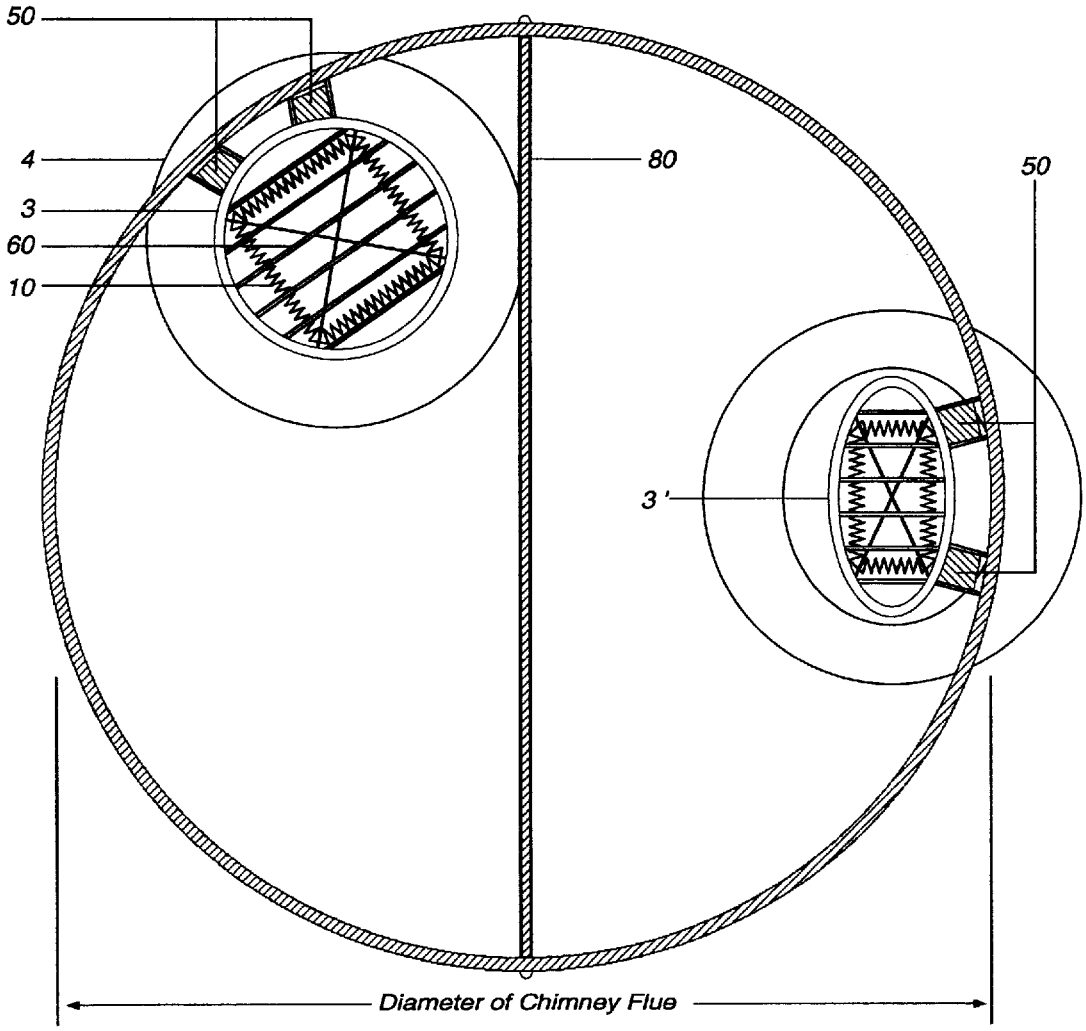
FIG. 2 is a top view of a flue having the device installed and also shows an alternative version of the device.

FIG. 2 shows a top view of the device when it is installed into a flue. As can be seen in this figure, the device uses two magnets 50 to attach the device to the metal flue. The device is so positioned that the bulbous portion extends below the bottom edge of the flue. Also shown in this figure is the alternative elliptical design 3 ' of the upper portion.

The device represents an easy and economical way of creating an updraft in a chimney prior to the lighting of a fire. The device is lightweight and easy to operate. It requires no special tools or power supply. Most advantageously, the device can be used with any pre-existing chimney without the need for any large expense in retrofitting the chimney. The device quickly and easily introduces a heated air source to a chimney to heat the flue and create an updraft. This eliminates any down draft from the cold outside air carrying into the room having the fireplace and bringing the smoke and fumes of a new fire with it.

Although the invention has been described with reference to a preferred embodiment, the description is not intended to be limiting. Several modifications would be apparent to one of ordinary skill in the art without deviating from the spirit and scope of the invention. The invention is only meant to be limited by the appended claims.

Figure 3:
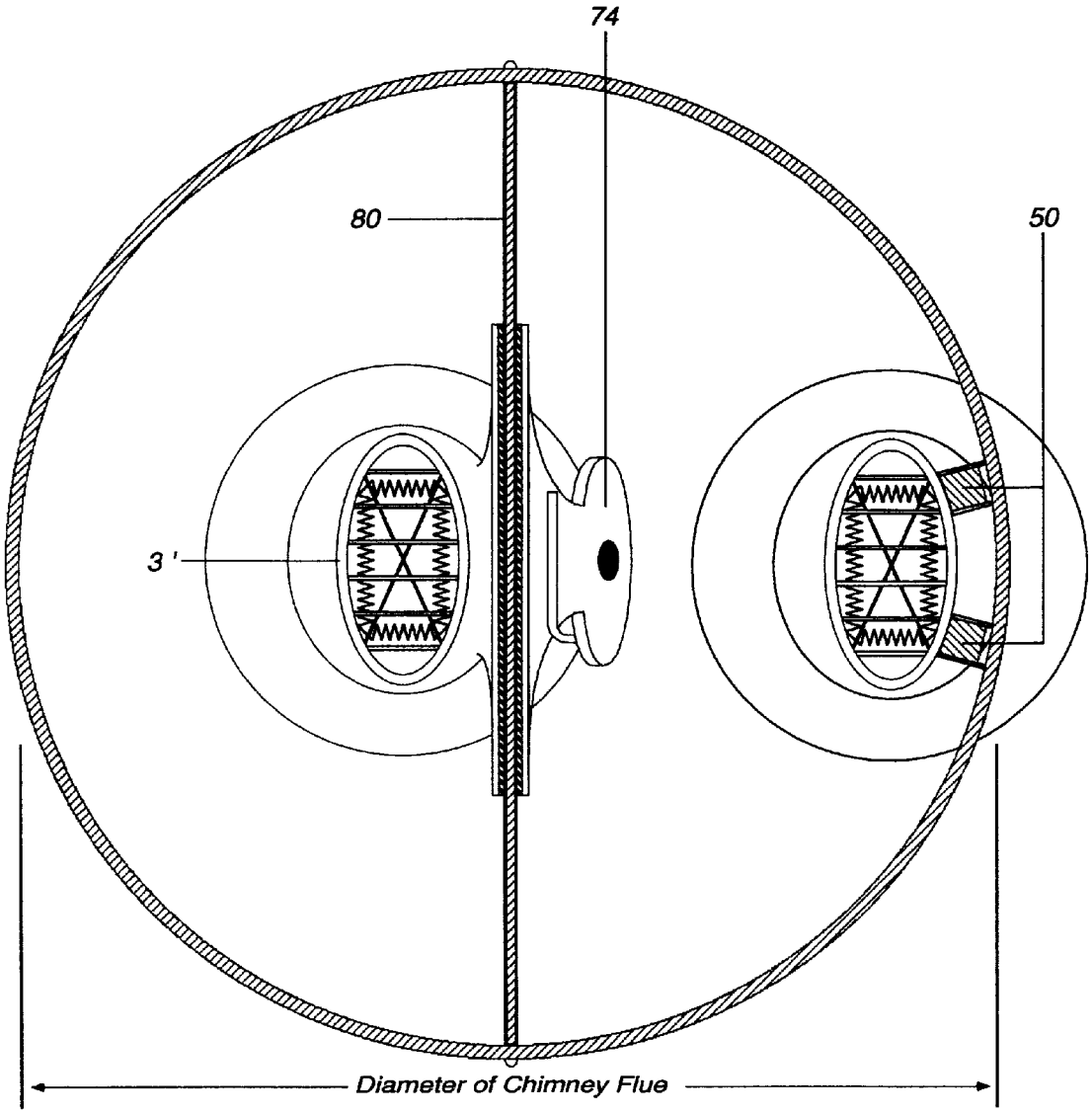
FIG. 3 is a top view of a flue having an elliptical nozzle attached to the side of the flue by magnets and to the flue damper by a clip.
Figure 4:
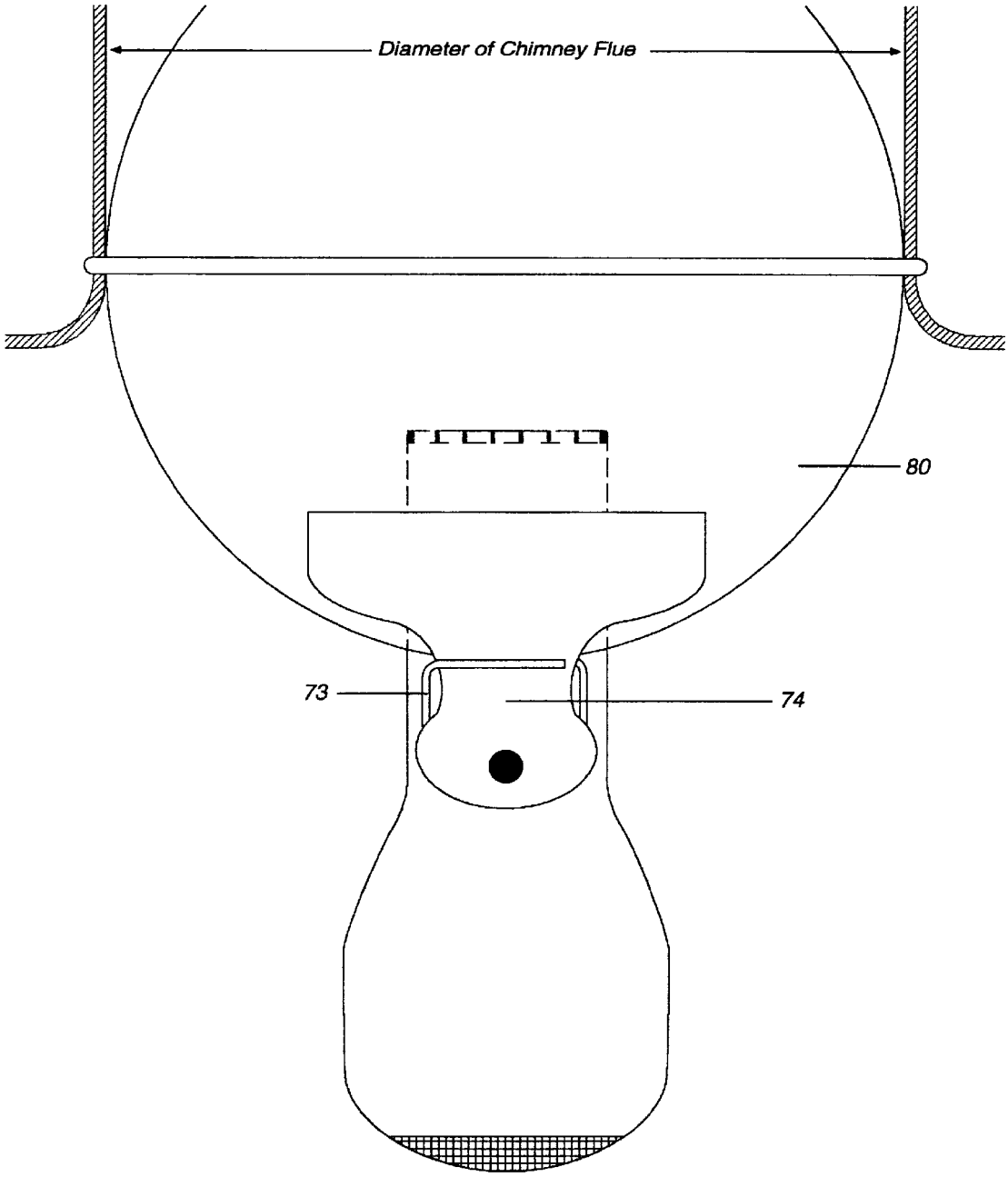
FIG. 4 is a front view of the heater attached to a flue damper by a clip.

Shown in FIG. 3 is the various ways that a heater can be attached inside of a flue. FIG. 3 shows the magnets 50 attaching a heater with an elliptical nozzle attached to the side of the flue. As is shown, the magnets 50 are angled away from each other as they extend from the nozzle. This angle helps to account for the curvature of the flue. Also shown in the nozzle attached to the flue damper by a clip. This embodiment is more clearly shown in FIG. 4 which shows the front view of the heater attached to the flue damper. As can be seen, a spring biased jaw is attached to the heater. One spring biased clip is attached to the damper. The clip has two jaws that are biased together by a spring 73. The view of FIG. 4 shows how the moveable jaw 74 is on one side of the damper. The top of the heater is shown in phantom, since it is on the other side of the flue damper than the moveable jaw 74.

Figure 5:
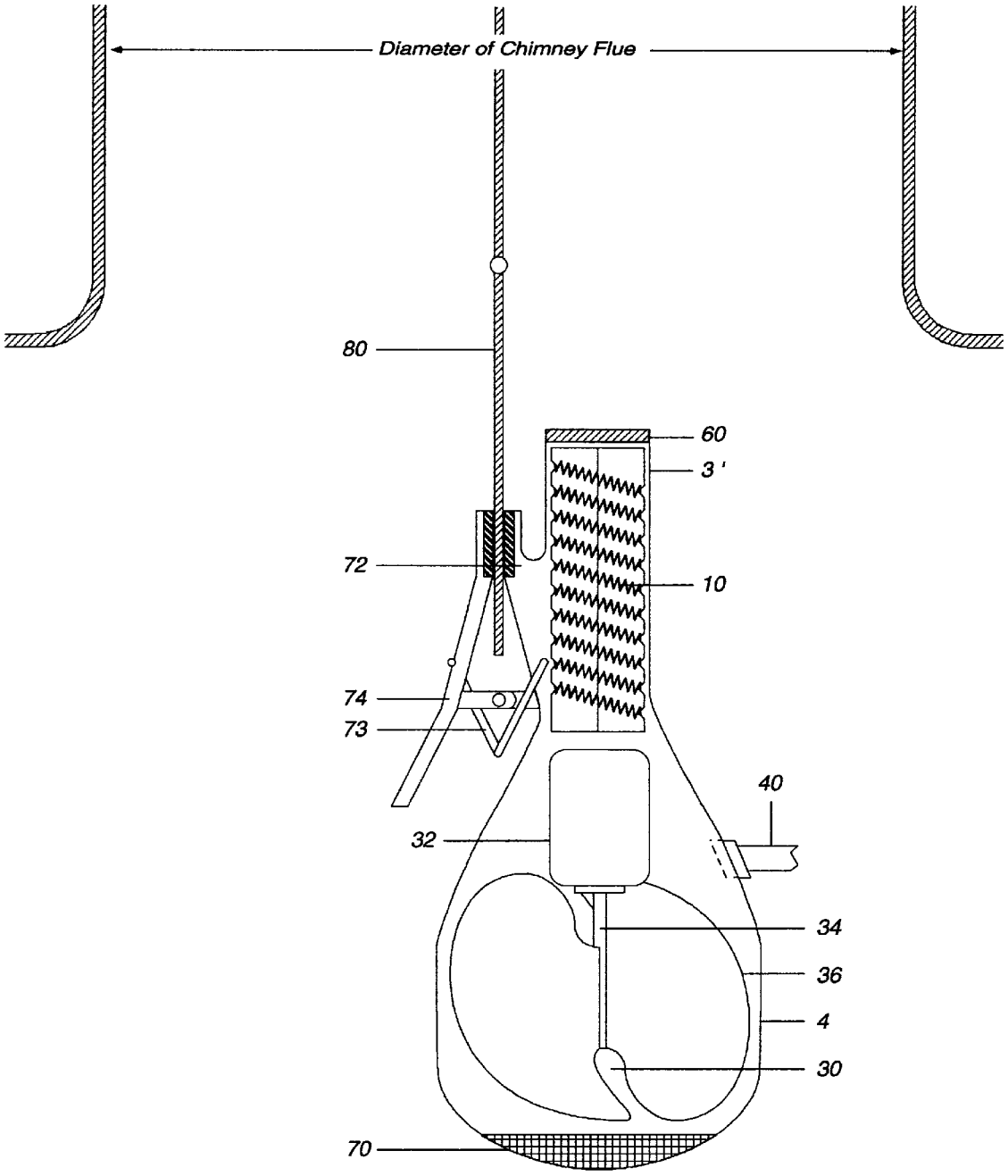
FIG. 5 is a side view of the heater attached to a flue damper by a clip.

The operation of the heater with a clip is more clearly shown in the side view shown in FIG. 5. In this view, the flue damper is open to be vertical. In this operation, the heater is simply clipped to the flue damper to be used. The clip has a stationary jaw 72 formed with the top of the heater and a moveable jaw 74. The two jaws are biased together by a spring 73. The force of the spring is sufficient so that the clamping force of the clip firmly holds the heater to the damper without fear of it falling off of the damper.

Figure 6:
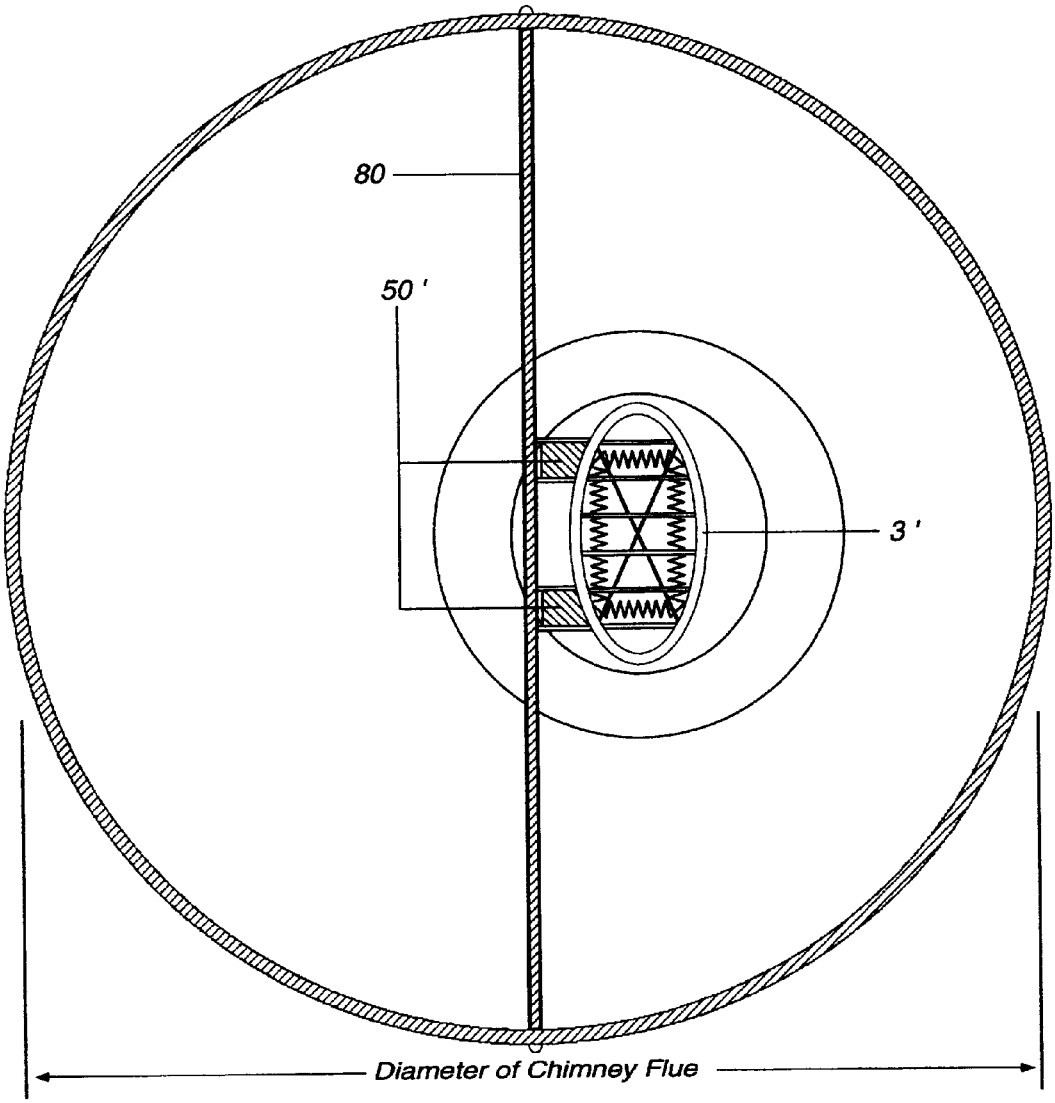
FIG. 6 is a top view of the heater attached to the flue damper by magnets.
Figure 7:
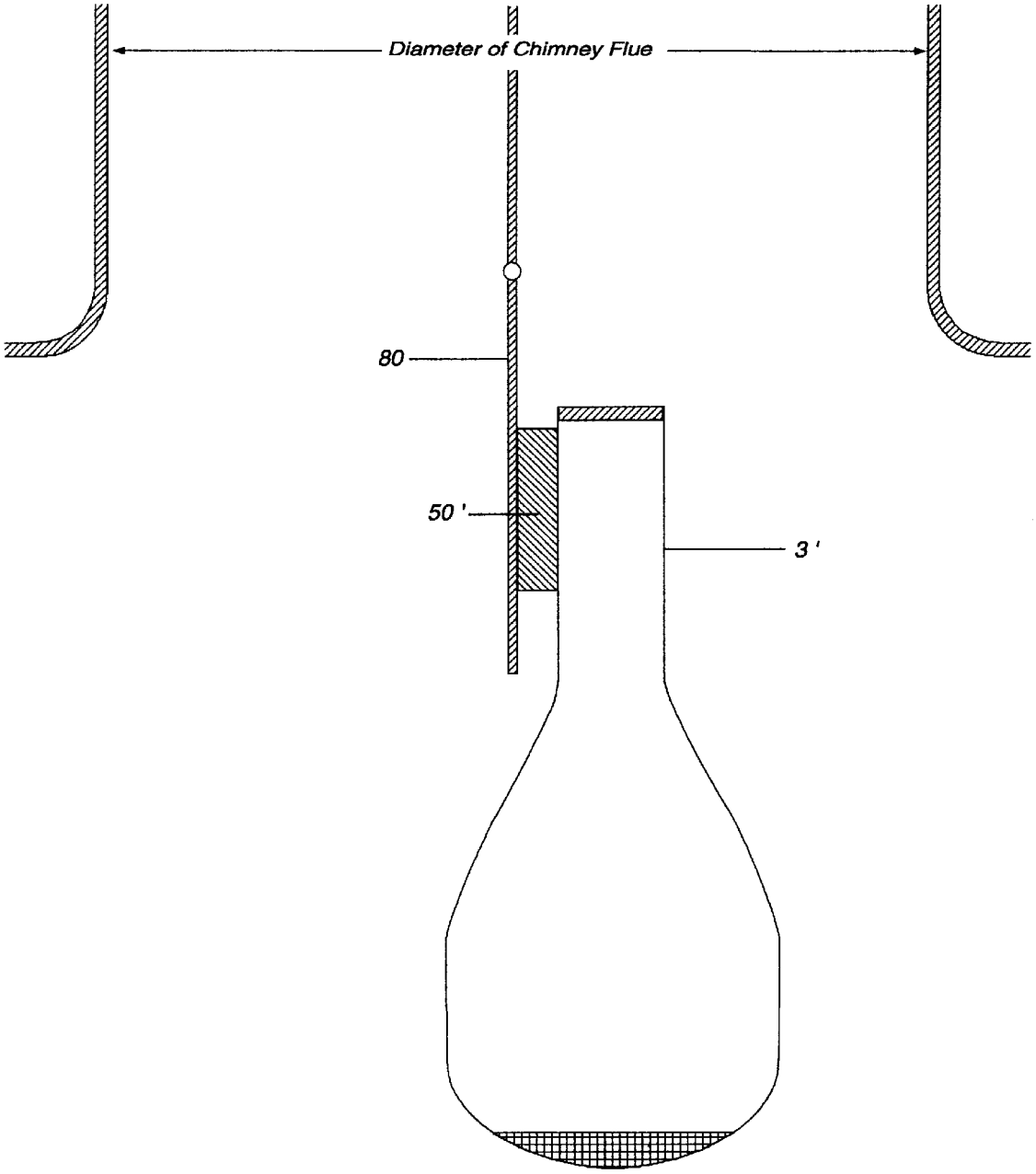
FIG. 7 is a side view of the heater attached to the flue camper by magnets.

A final embodiment of the flue heater is shown in FIGS. 6 and 7. In FIG. 6, the overhead view of the heater attached to the flue damper is shown. In this embodiment, magnets 50' are used to attach the heater to the flue damper. In this embodiment, as is seen in this drawing, the magnets are parallel to one another as they extend from the heater. This is because they are now attached to the flat surface of the damper.

A side view of the heater being attached to the flue damper by magnets is shown in FIG. 7. As is clear, the flue damper is open to a vertical position and the heater is attached to the metal damper by the use of magnets 50.

I claim:

1. A system for heating a flue, comprising:

a flue, a flue heater removably attached inside of said flue, said flue heater comprising:

an outer casing, a heater element located within the outer casing, wherein said flue has a flue damper, the flue heater removably attached to the flue damper.

2. The system of claim 1, further comprising a blower in said outer casing, said blower directing hot air upward.

3. The system for heating a flue of claim 1, wherein said flue heater is attached to said flue damper by a clip.

4. The system for heating a flue of claim 1, wherein the flue heater is attached to said flue damper by magnets.

* * * * *